United States Patent [19]

Tharp

[11] Patent Number: 5,013,493

[45] Date of Patent: May 7, 1991

[54] STAGGERED DIFFUSER ARRANGEMENT FOR WASTE WATER TREATMENT SYSTEMS

[75] Inventor: Charles E. Tharp, Columbia, Mo.

[73] Assignee: Environmental Dynamics, Inc., Columbia, Mo.

[21] Appl. No.: 468,190

[22] Filed: Jan. 22, 1990

[51] Int. Cl.[5] ..... B01F 3/04

[52] U.S. Cl. ..... 261/122; 261/124; 210/220

[58] Field of Search ..... 261/124, 122; 210/220

[56] References Cited

U.S. PATENT DOCUMENTS

| | | | |
|---|---|---|---|
| 2,438,342 | 3/1948 | Mallory | 261/122 |
| 3,208,935 | 9/1965 | Nesbitt | 261/124 |
| 3,347,537 | 10/1967 | Morgan | 210/220 |
| 3,841,997 | 10/1974 | McGee | 261/122 |
| 4,818,446 | 4/1989 | Schreiber et al. | 261/122 |

*Primary Examiner*—Tim Miles

*Attorney, Agent, or Firm*—Kokjer, Kircher, Bradley, Wharton, Bowman & Johnson

[57] ABSTRACT

A wate water aeration system in which tubular diffusers are arranged with short and long diffuser assemblies alternating along the length of each air lateral submerged in the treatment basin. This arrangement provides application of air which is widely distributed in the basin and descreases the upward water velocity to increase the air bubble residence time for enhanced oxygen transfer efficiency. When plural air laterals are used, each long diffuser assembly is axially aligned with a short diffuser assembly on the adjacent air lateral. Each long diffuser can either be constructed to discharge air along its entire length or it can include an imperforate pipe section which occupies one half of the diffuser length adjacent to the air lateral.

15 Claims, 2 Drawing Sheets

STAGGERED DIFFUSER ARRANGEMENT FOR WASTE WATER TREATMENT SYSTEMS

BACKGROUND OF THE INVENTION

This invention relates generally to the aeration of waste water and more particularly to a method and apparatus for aerating waste water in an improved manner.

Waste water is commonly treated by aerating the treatment basin in which the waste water is contained. In order to achieve overall efficiency in the aeration system, the efficiency of the oxygen transfer to the waste water should be as high as possible. High oxygen transfer efficiency requires that the diffuser media have a large surface area exposed to the waste water, that the diffusers be located near the floor of the basin, and that strong water circulation patterns (velocity) to the surface of the basin be avoided to maximize bubble residence time. The benefits of longer bubble residence in improved efficiency are well documented in the industry.

Tubular diffusers have many advantages over other types of diffusers, but they are also disadvantageous in some respects due primarily to structural limitations and system geometry. In the past, the length of tubular diffusers has been limited to about two feet because the leverage effect on longer diffusers causes excessive stress on the connection between the diffuser and the air lateral that supplies air to it. With longer diffusers, the uplift force and/or flexure of the diffuser from energy applied by moving water can lead to failure that can disable the entire system. Consequently, the practice has been to install tubular diffusers each two feet long along the length of each submerged air lateral, with the diffusers arranged in pairs extending on opposite sides of the lateral pipe. The effect is to provide evenly spaced diffuser assemblies each centered on the lateral piping and each extending approximately two feet on each side of the air lateral. In addition, economics of first cost suggest use of as few laterals as possible with diffusers close together on the lateral. This condition dramatically reduces system efficiency (increases energy). Therefore, the purpose of this invention is to achieve maximum mixing and oxygen transfer efficiency (minimum energy) with uniform or full floor coverage with diffusers.

In order to provide effective coverage of the basin, it is necessary to utilize a relatively large number of air laterals with relatively widely spaced diffusers. The large number of laterals and piping of conventional diffusers adds significantly to the capital costs of the installation. If the diffusers are arranged in uniform rows ,a strong directional water pumpage to the surface is created at each lateral pipe, and this also results in an undesirable roll pattern of the water circulation. The water flows rapidly upwardly above each air lateral, laterally away from the lateral, and then in a roll pattern back downwardly. The resulting pumpage of the water carries the air bubbles quickly to the surface so that their residence time in the waste water is relatively short and the oxygen transfer efficiency is reduced accordingly. In addition to short residence time, the ratio of bubble velocity to water velocity is small, thus reducing shear on the bubble surface and resulting in the reduced oxygen transfer at the bubble/liquid interface.

Because the velocity with which each air bubble moves to the surface is the sum of the bubble rise velocity and the upwardly velocity component of the water in which the bubble is carried, the residence time can be increased by decreasing the water velocity or the pumpage rate. Consequently, the high rate of water movement that results from strong directional pumpage effects is undesirable and reduces the efficiency of the aeration process. However, some water circulation is desirable in order to prevent the settling of biological solids. Thus, in actual practice, it is necessary to effect a compromise between oxygen transfer efficiency and adequate water circulation when using a roll pattern. By using full floor coverage of diffusers, proper distribution of energy produces proper mixing and efficient oxygen transfer.

SUMMARY OF THE INVENTION

The present invention is directed to an aeration system in which tubular diffusers are arranged to provide a mixing pattern that maximizes free bubble rise through the waste water and which avoids excessive direction liquid pumpage while at the same time achieving enough water circulation to avoid undue settling of solids using proper distribution of energy. In accordance with the invention, relatively long diffusers each four feet in length are arranged in axially aligned pairs and are alternated along the air lateral with relatively short diffusers that are each two feet long. The effect of this diffuser arrangement is that diffusers each effectively eight feet long alternate with diffusers each effectively four feet long. Because of the non-uniformity of the diffuser arrangement, the three dimensional circulation pattern that is created minimizes the vertical directional pumpage and allows the air bubbles to rise to the surface due to their buoyancy, thus maximizing their residence time maximizing bubble surface shear, and enhancing the oxygen transfer efficiency.

Each long diffuser can be perforated along its entire length or have an imperforate pipe or the two feet adjacent to the lateral pipe and a two foot long porous membrane diffuser on the outer two feet of the diffuser length. Thus, there is no significant overlap in the bubbles that are emitted from the short diffusers and those emitted from the long diffusers. Consequently, there is no appreciable interaction between the bubbles from the long and short diffusers, maximizing free bubble rise, maximizing bubble residence time and enhancing the mixing pattern accordingly. Equally significant, the aeration coverage is four feet on each side of the air lateral, and the number of laterals required is significantly reduced for proper energy distribution in comparison to the conventional arrangement which covers only two feet on each side of each air lateral. This reduction in the capital cost requirements is an important benefit of the present invention, and it is achieved without requiring added laterals, added diffusers, or sacrificing in the basin floor coverage.

In applications with a particularly high oxygen demand, the long diffusers can be equipped with porous membranes along their entire four foot length in order to increase the membrane area as required to meet the oxygen demand. It is a feature of the present invention that this type of diffuser can be used interchangeably with a diffuser having an imperforate pipe along half its length.

Ordinarily, a number of laterals are installed parallel to one another along the basin floor in order to provide complete coverage of the basin. Due to the unique staggered arrangement of the diffusers, it is possible to arrange each long diffuser assembly in axial alignment with a corresponding short diffuser assembly on the adjacent lateral or laterals. This results in uniform coverage of the basin while retaining all of the advantages that are provided by alternating long and short diffusers on all of the air laterals in the basin.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
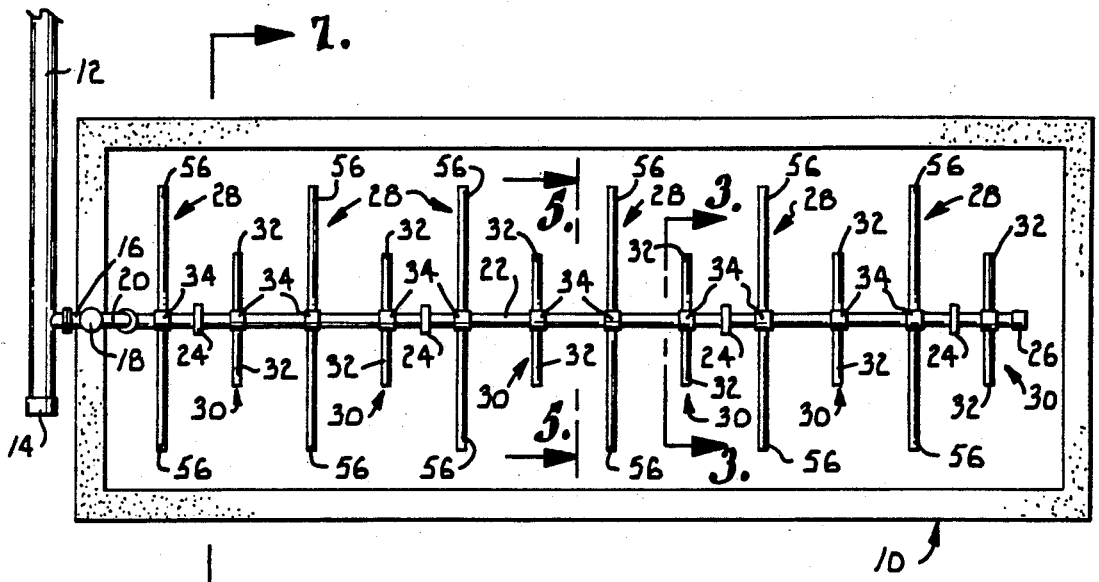
FIG. 1 is a diagrammatic top plan view of an aeration system which is equipped with a single air lateral having diffusers arranged in accordance with a preferred embodiment of the present invention.

Referring now to the drawings in more detail and initially to FIG. 1, numeral 10 generally designates a basin which contains waste water that is to be treated. In accordance with the present invention, the waste water is treated by an aeration system which includes a relatively large supply pipe 12 which receives air under pressure and which is closed at one end by an end cap 14. A branch pipe 16 extends from the supply pipe 12 and connects with a valve 18. Extending from the valve 18 is a pipe 20 which extends downwardly into the basin 10 generally along one of its end walls. The bottom end of the branch pipe 20 connects with a horizontal air lateral 22 which extends along the floor of the basin 10 and is held down by a plurality of anchors 24 spaced along the length of the air lateral 22. The end of the lateral remote from the branch pipe 20 is provided with an end cap 26.

The air lateral 22 is equipped with a plurality of relatively long diffuser assemblies which are identified by numeral 28 and by a plurality of relatively short diffuser assemblies which are generally identified by numeral 30. Each of the short diffuser assemblies 30 includes a pair of axially aligned tubular diffusers 32 which are substantially identical to one another and which are illustrated in more detail in FIG. 3. The ends of the long diffusers are adjacent to the basin walls to provide full floor coverage.

Figure 3:
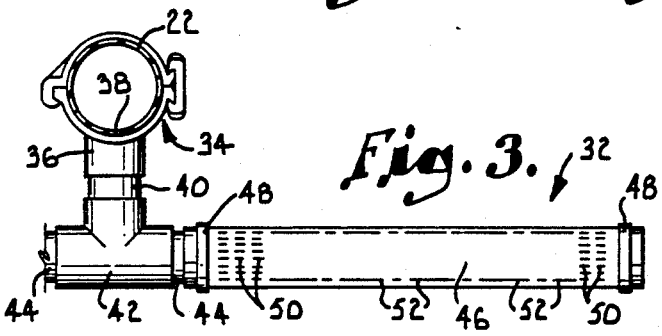
FIG. 3 is a fragmentary sectional view on an enlarged scale taken generally along line 3—3 of FIG. 1 in the direction of the arrows.
Figure 4:
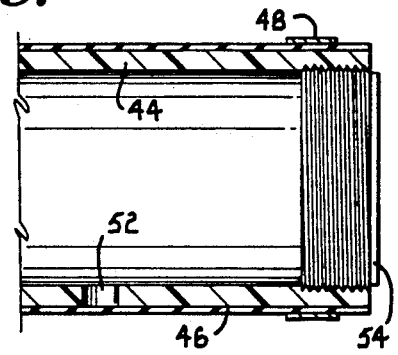
FIG. 4 is a fragmentary sectional view of the outer end of one of the diffusers.

Each diffuser assembly 30 is mounted to the air lateral 22 by a saddle assembly which is identified by numeral 34 and which is described in detail in pending application Ser. No. 340,265, filed on Apr. 19, 1989 by Charles E. Tharp and entitled, "Diffuser Mounting Arrangement for Waste Water Aeration Systems", which pending application is incorporated herein by reference. With reference to FIG. 3 in particular, the saddle 34 is provided with an outlet spout 36 which is supplied with air from the air lateral 22 through an outlet opening 38 which is drilled in the bottom of the air lateral. A nipple 40 is solvent welded to the inlet of a T fitting 42, and the top end of the nipple 40 has a threaded (or glued) connection with the outlet spout 36 in order to mount the diffuser assembly to the air lateral 22. Reference may be made to pending application Ser. No. 340,265 for a more detailed description of the diffuser mounting arrangement and the various benefits it provides.

Each of the diffusers 32 includes a pipe 44, and the two pipes 44 in the diffuser assembly 30 are fitted in the T fitting 42 in axial alignment with one another. Preferably, each pipe 44 and the T fitting 42 are constructed of polyvinyl chloride or a similar material, and the pipes 44 are preferably solvent welded to the T fitting 42.

Each diffuser 32 is a tubular diffuser which preferably includes a porous membrane 46 sleeved over the pipe 44 and secured thereto by hose clamps 48 applied to the opposite ends of the membrane 46. The membrane 46 has a plurality of fine pores 50 through which air is discharged into the waste water in the form of relatively fine bubbles. It should be noted that the invention is equally well suited for coarse bubble diffusers and other types of tubular diffusers.

Figure 5:
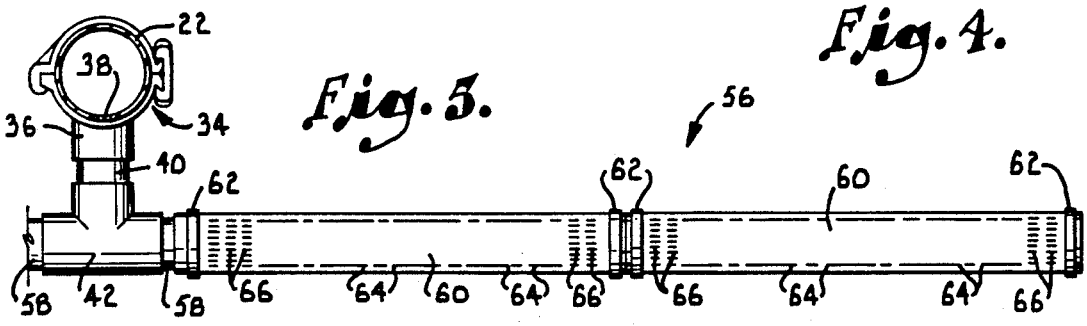
FIG. 5 is a fragmentary sectional view taken generally along line 5—5 of FIG. 1 in the direction of the arrows.

As best shown in FIG. 5, the pipe 44 is provided with a plurality of ports 52 through which air can pass from the inside of the pipe 44 to the inside of the membrane 46 and then through the pores 50 into the waste water. The end of each pipe 44 remote from the T fitting 42 is internally threaded and receives a threaded end cap 54 which closes the pipe.

Each of the short diffusers 32 is preferably approximately two feet long. Consequently, each diffuser assembly 30 includes a pair of axially aligned diffusers, and the overall length of each of the short diffuser assemblies 30 is approximately four feet, with the diffusers 32 in each diffuser assembly located on opposite sides of the air lateral 22.

Each of the long diffuser assemblies 28 includes a pair of axially aligned diffusers 56 which are each approximately four feet long or twice as long as each of the relatively short diffusers 32. As best shown in FIG. 5 in particular, each long diffuser assembly 28 is mounted by a saddle arrangement 34 identical to that used to mount each of the short diffusers. Each long diffuser 56 includes a pipe 58 which is secured in the T fitting 42 in axially alignment with the pipe 58 of the other diffuser in the assembly. A pair of porous membranes 60 are sleeved around the pipe 58 and secured generally end to end by hose clamps 62. Each pipe 58 has a plurality of openings 64 which are spaced along the entire length of the pipe and which discharge air into the two membranes 60. Consequently, the membranes 60 discharge air into the waste water in small bubbles along the entire diffuser length. The air passes through pores 66 in the membranes.

As previously indicated, the long diffuser assemblies 28 and the short diffuser assemblies 30 alternate with one another along the length of the air lateral 22. The short diffuser assemblies 30 are parallel to one another and are spaced uniformly apart from one another. Similarly, the long diffuser assemblies 28 are spaced apart and parallel to one another with one of the long diffuser assemblies being located midway between and parallel to each pair of short diffuser assemblies 30. Thus, each long diffuser assembly 28 projects four feet on opposite sides of the air lateral 22, while each short diffuser assembly projects only two feet on each side of the air lateral. Approximately one-half the length of each long diffuser 56 projects beyond the end of each short diffuser 32.

In operation of the aeration system, the air that is supplied to pipe 12 flows to the air lateral 22 and to each of the diffusers 32 and 56. The membrane 46 of each short diffuser 32 occupies substantially the entire length of the diffuser and discharges the air in bubbles which are distributed relatively uniformly along the entire length of each short diffuser 32. Similarly, the two membranes 60 on each long diffuser 56 occupy substantially the entire length of the diffuser so that the air bubbles are discharged generally uniformly along the entire length of each of the long diffusers.

Figure 7:
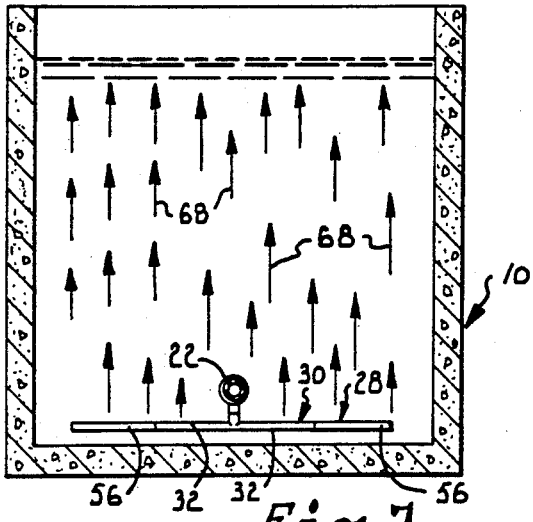
FIG. 7 is a fragmentary sectional view taken generally along line 7—7 of FIG. 1 in the direction of the arrows and illustrating the mixing pattern achieved as the diffuser arrangement of the present invention.

By virtue of the staggered arrangement of the diffusers, the water in the basin 10 is circulated in the gentle non-directional pattern best illustrated in FIG. 7. As indicated by the directional arrows 68, the air rises through the water above each diffuser 32 and 56 with minimum velocity (maximum retention) and then exits at the water surface. The water is mixed and agitated with non-directional energy. This gentle mixing pattern of the water circulation is sufficient to prevent biological solids from settling to any significant extent, and it also avoids undue pumpage. The upward velocity of the water is relatively low (for example, on the order of approximately 0.5 feet per second as contrasted with approximately 3 feet per second water velocity achieved by conventional tubular systems of the type shown in FIG. 8). As a consequence, the air bubbles which are emitted from the diffusers rise to the surface as a result principally of their own buoyancy, with only a small contribution from the water velocity. The result is that the residence time of the air bubbles in the waste water is increased, by a factor of 3 to 8 times and the efficiency of the oxygen transfer is increased accordingly.

Figure 8:
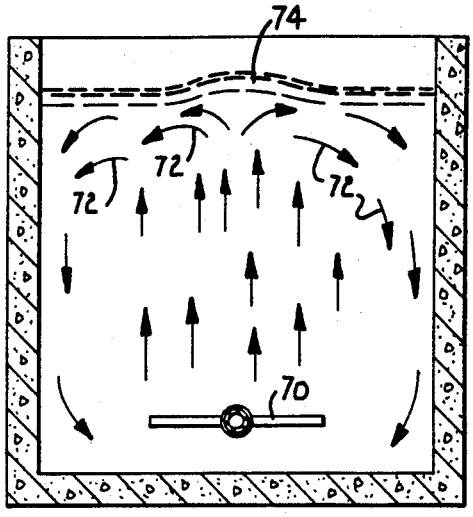
Fig. 8. PRIOR ART
FIG. 8 is a fragmentary sectional view similar to FIG. 7 but showing the mixing pattern achieved by prior art diffusers.

FIG. 8 depicts a conventional tubular diffuser system in which there is no staggered arrangement of diffusers 70. As illustrated by the directional arrows 72, this creates a strong roll pattern due to the insufficient coverage of the basin. In conventional installations having multiple rows of diffusers, a similar roll pattern results from the relatively widely spaced rows of diffusers 70 in conventional diffuser arrangements. This roll pattern is accompanied by directional pumpage which decreases the air bubble residence time in the basin and thus reduces the oxygen transfer efficiency. Surface boils as indicated at 74 are also created.

Figure 6:
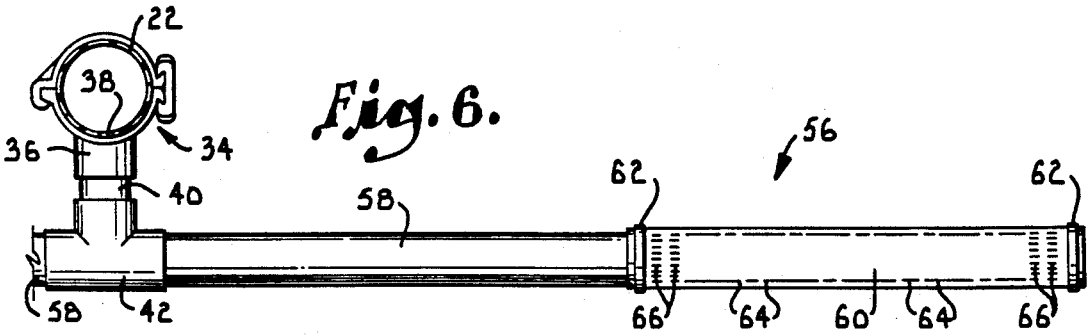
FIG. 6 is a fragmentary sectional view similar to FIG. 5, but showing an alternative construction for each of the long diffusers in the aeration system.

FIG. 6 illustrates an alternative form of the long diffusers 56 which may be included in the aeration system. The diffuser shown in FIG. 7 differs from that shown in FIG. 6 only in that pipe 58 in imperforate for approximately half its length, with only the outer approximately two feet being provided with openings 62. Only a single membrane 60 is provided on each of the diffusers, and it is located on the outer end portion of the diffuser such that it covers all of the openings 62.

When the aeration system is provided with long diffusers of the type shown in FIG. 7, substantially the same circulation effect is provided as that described previously. The only difference is that there is no overlap in the bubbles emitted from the long diffusers and the short diffusers, because only the outer one-half of each long diffuser generates bubbles. Accordingly, there is no appreciable interference in the bubble patterns from the long and short diffusers, regardless of how far apart they are spaced.

Figure 2:
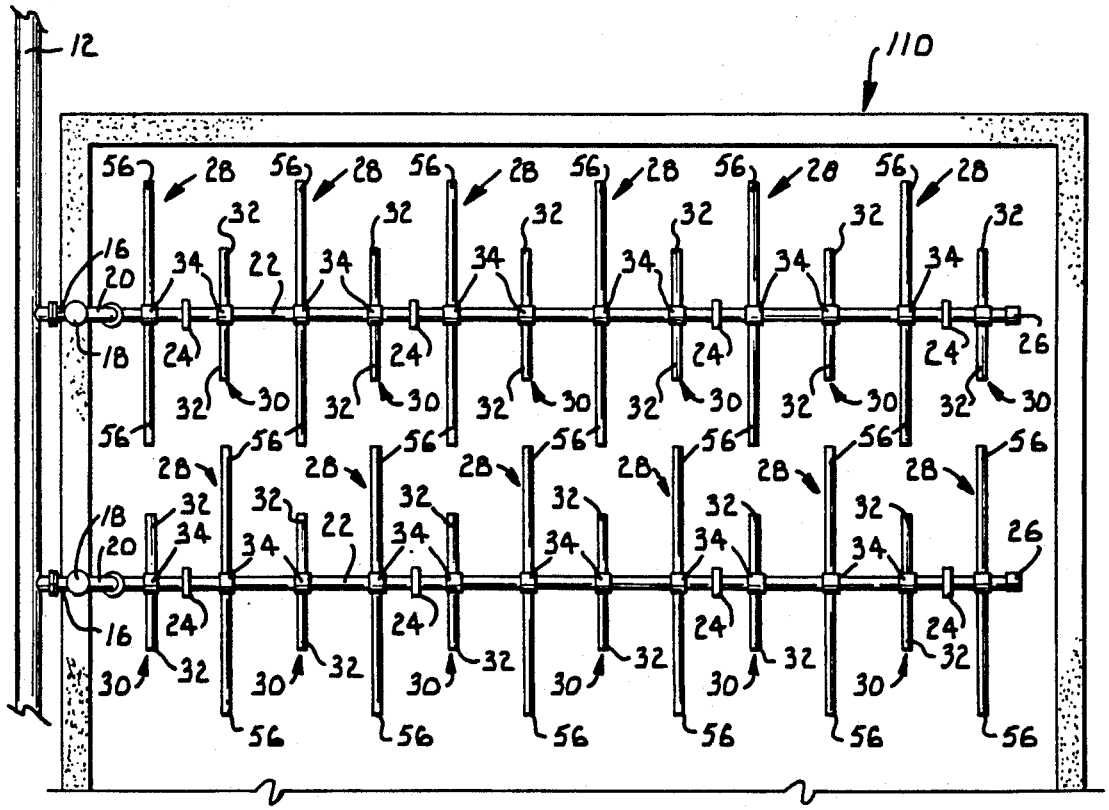
FIG. 2 is a fragmentary top plan view of a waste water treatment basin in which a pair of parallel air laterals are each equipped with diffusers which are staggered in accordance with the present invention.

It is contemplated that diffusers of the type shown in FIG. 6 will normally be used, and that diffusers of the type shown in FIG. 5 will be used only in applications where relatively high oxygen demand exists. In either case, the structural strength provided by the mounting saddles 34 permits the relatively long diffusers to be used without structural problems being encountered in normal service The diffuser arrangement of the present invention can be employed in treatment basins having virtually any size. With reference to FIG. 2 in particular, a relatively large basin 110 may be provided with more than one air lateral 22, and the air laterals 22 extend generally along the floor of the basin spaced apart and parallel to one another. Although only two laterals 22 are shown in FIG. 2, it is to be understood that additional air laterals can be provided depending upon the basin size.

In the arrangement shown in FIG. 2, each of the laterals 22 is provided with air from the supply pipe 12 through a similar branch piping system. The long diffuser assemblies 28 and short diffuser assemblies 30 are arranged in alternating fashion along the length of each branch pipe 22. However, the diffusers are reversed on the adjacent branch pipes 22. In other words, each long diffuser assembly 28 is axially aligned with a short diffuser assembly 30 associated with each adjacent air lateral 22, and each short diffuser assembly 30 is likewise axially aligned with an adjacent long diffuser assembly 28. By this arrangement, the basin is covered in a generally uniform manner with diffuser media, and the benefits of the alternating short and long diffusers are achieved for each air lateral 22. At the same time, fewer air laterals are required than in the case where each diffuser is only two feet long and the laterals 22 must be spaced more closely together than is the case with the arrangement shown in FIG. 2.

It is noted that the same number of laterals can be used in a system of all two foot long diffusers. However, there is then a sacrifice of considerable energy, i.e., reduced oxygen transfer.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense

Having thus described the invention, what is claimed is:

1. A waste water treatment system for aerating waste water, comprising:

a supply conduit for receiving air under pressure;

at least one branch pipe extending from the supply pipe and into the waste water;

an air lateral communicating with said branch pipe to receive air therefrom, said air lateral being submerged in the waste water;

a plurality of relatively long diffuser assemblies each including at least one relatively long diffuser having a generally tubular configuration, each of said long diffusers communicating with the air lateral to receive air therefrom and being constructed to discharge air into the waste water in bubbles;

a plurality of relatively short diffuser assemblies each including at least one relatively short diffuser which is shorter than the long diffusers and which is generally tubular, each of said short diffusers communicating with the air lateral to receive air therefrom and being constructed to discharge air into the waste water in bubbles; and means for connecting said diffuser assemblies to said air lateral in a pattern wherein the long assemblies and short assemblies alternate along the length of the air lateral with the diffusers in each assembly projecting on opposite sides of said air lateral.

2. The system of claim 1, wherein each short diffuser is approximately one half the length of each long diffuser.

3. The system of claim 2, wherein:

each short diffuser is constructed to discharge air therefrom along substantially the entire diffuser length; and each long diffuser is constructed to discharge air therefrom along substantially the entire diffuser length.

4. The system of claim 2, wherein each long diffuser comprises:

a substantially imperforate diffuser section occupying approximately one half the diffuser length; and a perforate diffuser section constructed to discharge air therefrom along approximately one half the diffuser length, said perforate diffuser section being more distant from the air lateral than said imperforate diffuser section.

5. The system of claim 4, wherein each short diffuser is constructed to discharge air therefrom along substantially the entire diffuser length.

6. The system of claim 1, wherein each diffuser is constructed to discharge air therefrom along substantially the entire diffuser length.

7. The system of claim 1, wherein each long diffuser comprises:

a substantially imperforate diffuser section; and a perforate diffuser section located outboard of said imperforate section and constructed to discharge air along substantially the entire length of the perforate section.

8. The system of claim 1 including:

a second air lateral submerged in the waste water at a location to one side of and generally parallel to the first mentioned air lateral;

means for supplying air under pressure to said second air lateral;

a second plurality of relatively long diffuser assemblies each including at least one relatively long diffuser having a generally tubular configuration and each communicating with said second air lateral to receive air therefrom, said long diffuser assemblies in said second plurality thereof being constructed to discharge air in bubbles and being substantially axially aligned with corresponding short diffuser assemblies; and a second plurality of relatively short diffuser assemblies each including at least one relatively short diffuser having a generally tubular configuration and each communicating with said second air lateral to receive air therefrom, said short diffuser assemblies in said second plurality thereof being constructed to discharge air in bubbles and being substantially axially aligned with corresponding long diffuser assemblies in the first mentioned plurality thereof.

9. The system of claim 8, wherein said air supplying means comprises a branch pipe extending from the supply pipe and communicating with said second air lateral.

10. A method of aerating waste water comprising the steps of:

submerging in the waste water a plurality of relatively short diffusers which are spaced apart and generally parallel to one another;

submerging in the waste water a plurality of relatively long diffusers which are longer than the short diffusers and which are spaced apart and generally parallel to one another at locations between adjacent pairs of short diffusers and generally parallel thereto with opposite outer end portions of each long diffuser projecting beyond the ends of the short diffusers;

discharging air in bubbles from each short diffuser along substantially the entire diffuser length; and discharging air in bubbles from each long diffuser at least along substantially the entire length of each end portion thereof 11. The method of claim 10, wherein said step of discharging air in bubbles from each long diffuser comprises discharging air in bubbles from each long diffuser along only the length of each end portion thereof 12. The method of claim 10, wherein said step of discharging air in bubbles from each long diffuser comprises discharging air in bubbles from each long diffuser along substantially the entire diffuser length 13. A method of aerating waste water comprising the steps of:

submerging in the waste water a first bank of relatively short diffusers which are spaced apart and generally parallel to one another;

submerging in the waste water a first bank of relatively long diffusers which are longer than the short diffusers and which are spaced apart and generally parallel to one another at locations between adjacent pairs of the short diffusers and generally parallel thereto with opposite outer end portions of each long diffuser projecting beyond the ends of the short diffusers;

submerging in the waste water a second bank of said short diffusers at locations spaced apart and generally parallel to one another with each one of the short diffusers in said second bank located substantially in axial alignment with a corresponding one of the long diffusers in said first bank thereof;

submerging in the waste water a second bank of said long diffusers at locations spaced apart and generally parallel to one another with opposite outer end portions of each long diffuser in said second bank projecting beyond the ends of the short diffusers in said second bank and with each one of the long diffusers in said second bank located substantially in axial alignment with a corresponding one of the short diffusers in said first ban thereof;

discharging air in bubbles from each short diffuser along substantially the entire diffuser length; and discharging air in bubbles from each long diffuser at least along substantially the entire length of each end potion thereof.

14. The method of claim 13, wherein said step of discharging air in bubbles from each long diffuser comprises discharging air in bubbles from each long diffuser along only the length of each end portion thereof.

15. The method of claim 13, wherein said step of discharging air in bubbles from each long diffuser comprises discharging air in bubbles from each long diffuser along substantially the entire diffuser length.

* * * * *